US011160718B2

(12) United States Patent
Lim

(10) Patent No.: US 11,160,718 B2
(45) Date of Patent: Nov. 2, 2021

(54) DEVICE FOR STRENGTHENING SPINAL MUSCLES

(71) Applicant: Sang-Man Lim, Namyangju-si (KR)

(72) Inventor: Sang-Man Lim, Namyangju-si (KR)

( * ) Notice: Subject to any disclaimer, the term of this patent is extended or adjusted under 35 U.S.C. 154(b) by 361 days.

(21) Appl. No.: 16/465,332

(22) PCT Filed: Dec. 12, 2017

(86) PCT No.: PCT/KR2017/014511
§ 371 (c)(1),
(2) Date: May 30, 2019

(87) PCT Pub. No.: WO2018/110928
PCT Pub. Date: Jun. 21, 2018

(65) Prior Publication Data

US 2019/0388295 A1 Dec. 26, 2019

(30) Foreign Application Priority Data

Dec. 13, 2016 (KR) ..... 10-2016-0169434

(51) Int. Cl.
*A61H 15/00* (2006.01)

(52) U.S. Cl.
CPC . *A61H 15/0078* (2013.01); *A61H 2015/0014* (2013.01); *A61H 2015/0028* (2013.01); *A61H 2201/1215* (2013.01); *A61H 2201/1626* (2013.01); *A61H 2205/081* (2013.01)

(58) Field of Classification Search
CPC ..... A61H 15/00; A61H 15/0078; A61H 15/0085; A61H 2015/007; A61H 2015/0021; A61H 2015/0014; A61H 2015/0071; A61H 23/00; A61H 23/02; A61H 23/0263; A61H 23/0272; A61H 23/0281
See application file for complete search history.

(56) References Cited

U.S. PATENT DOCUMENTS 4,422,448 A * 12/1983 Sugai ..... A61H 1/00 601/102
6,213,962 B1 * 4/2001 Shimizu ..... A61H 15/0078 601/90

FOREIGN PATENT DOCUMENTS

| | | | |
|---|---|---|---|
| JP | 10-052468 | A | 2/1998 |
| JP | 2864374 | B1 | 3/1999 |
| JP | 11-128302 | A | 5/1999 |
| KR | 10-1999-0071355 | A | 9/1999 |
| KR | 20-2000-0020563 | U | 12/2000 |
| KR | 20-0402907 | Y1 | 12/2005 |
| KR | 10-0996489 | B1 | 11/2010 |

* cited by examiner

*Primary Examiner* — Samchuan C Yao
*Assistant Examiner* — Nathan M Le
(74) *Attorney, Agent, or Firm* — Novick, Kim & Lee, PLLC; Jae Youn Kim

(57) ABSTRACT

A device for strengthening spinal muscles is provided. The device can elastically perform acupressure along uneven portions of the spine, the device can relieve a patient's pain, prevent skin damage due to acupressure that is repeatedly performed several times, and effectively maintain contact with a cervical spine for a long time.

2 Claims, 8 Drawing Sheets

DEVICE FOR STRENGTHENING SPINAL MUSCLES

TECHNICAL FIELD

The present invention relates to a device for strengthening spinal muscles, the device enhancing strength and flexibility of spinal muscles surrounding vertebrae.

The spine consists of various joints and nerves, including the vertebral body and the intervertebral discs and serves as a pillar or an axis of the human body and to maintain balance in rest or in motion. The spine consist of seven cervical vertebrae, twelve thoracic vertebrae, five lumbar vertebrae, five sacral vertebrae, and four coccygeal vertebrae from the top, and an intervertebral disc lies between adjacent vertebrae in the spine to function as a shock absorber for the spine.

Spinal diseases such as scoliosis, lordosis, kyphosis, spinal disc herniation, spinal pain syndrome, and the like are caused by general movement, such as walking or lifting objects, which may put an excessive burden on the spine.

Scoliosis is a medical condition in which the spine has an abnormal sideways curve than being straight when viewed from the front. Lordosis is a medical condition in which the thoracic vertebrae or the sacrum vertebrae of the lower back region are excessively bent forward, so that the abdomen and the pelvis protrude. On the other hand, kyphosis is a medical condition in which the thoracic vertebrae or the sacrum vertebrae are bent excessively backwardly, such as the elderly walking with their back and waist bent. In addition, spinal disc herniation is a medical condition in which a intervertebral disc tears and escapes, and generally refers to disc disease. Spinal pain syndrome is a disease that causes spinal pain due to various causes.

The above spinal-related diseases are often caused by the bad posture of the spinal muscles including the semispinalis, the multifidus, and the rotator surrounding the vertebrae. Therefore, by increasing the strength and flexibility of the spinal muscles, the blood circulation of the muscles is improved, which brings the proper nutrition supply, cell regeneration, and inflammation relief, and so on to damaged areas so that the damaged areas can be healed.

BACKGROUND ART

In order to correct such spinal diseases, Korean Patent No. 10-0996489 discloses CUSTOMIZED SPINAL CORRECTION DEVICE AND METHOD OF MANUFACTURING SAME, wherein a spine pressing plate and an auxiliary pressing plate of the device only push the spine from top to bottom. However, it is not enough for enhancing strength and flexibility of the spinal muscles.

In addition, Korean Utility Model No. 20-0402907 discloses MASSAGE BED EQUIPPED WITH MULTI ROLLING SYSTEM HAVING HORIZONTAL AND VERTICAL MOTIONS. The bed has a lower rolling portion 10, a three-stage rolling portion 20, and an upper rolling portion 30. The three-stage rolling portion 20 has three pivot shafts 21' maintaining an angle of 120 degrees therebetween and multiple press rollers 21 on the respective pivot shafts 21'. However, the ball-shaped press rollers continue to exert a force on a part of the human body, and the acupressure rollers connected to the three pivot shafts repeatedly push the cervical vertebrae of a patient with the same force, so that the patient may feel pain and the skin may hurt. In addition, the contact time with the cervical vertebrae is prolonged, but the pressing effect is insufficient since long-term dynamic press is required at regular intervals to strengthen the spinal muscles.

DISCLOSURE

Technical Problem

As a result of repeated studies to solve problems of the related art, the inventor of the present invention has found that when one or two press rollers, other than multiple press rollers, rotate eccentrically at a support portion and press a spine of the patient at a slower speed in accordance with to the curves of the spine, it is possible to prevent the patient from feeling feel pain, to protect the skin, and to maintain contact time with the cervical vertebrae effectively for a long time.

Accordingly, it is an objective of the present invention to provide a device for strengthening spinal muscles, the device configured to prolong the contact time with the cervical vertebrae while preventing the patient from feeling pain and preventing damage to the skin.

Technical Solution

The objectives of the present invention are attained to the invention with a device for strengthening spinal muscles according to first, second, and third embodiments below.

According to a first embodiment of the present invention, a device for strengthening spinal muscles is provided, the device including: a driving unit including a motor and a reducer; two support portions in which one of the support portions is connected to a shaft of the reducer and a remaining one is connected to a side wall of a housing; a press portion eccentrically connected to a disk of each of the support portions; and the housing accommodating the driving unit, the support portions, and the press portion.

According to a second embodiment of the present invention, the one of the support portions may be connected to the shaft of the reducer and the remaining one may be connected to the side wall of the housing, and the disk may have a supporter shaft on an outer side thereof and have a rectangular recess having a round upper portion and a flat lower portion in an inner side thereof by a predetermined depth. In addition, each of the support portions may include: a spring accommodated in the recess; a supporter supporting a press roller shaft; and a cover covering the recess to prevent separation of the spring and the supporter and having a rectangular cover opening having rounded upper and lower edges.

According to a third embodiment of the present invention, the device may further include: a spring, a supporter, a cover, and a press portion in an additional recess symmetrically disposed to the recess of the disk.

Advantageous Effects

As the device for strengthening spinal muscles according to the present invention dynamically presses in accordance with the curves of the spine, the device can prevent a patient from feeling pain, prevent the skin from being damaged by pressure that is repeatedly applied, and effectively maintain contact with the cervical vertebrae for a long time.

BEST MODE

Figure 1:
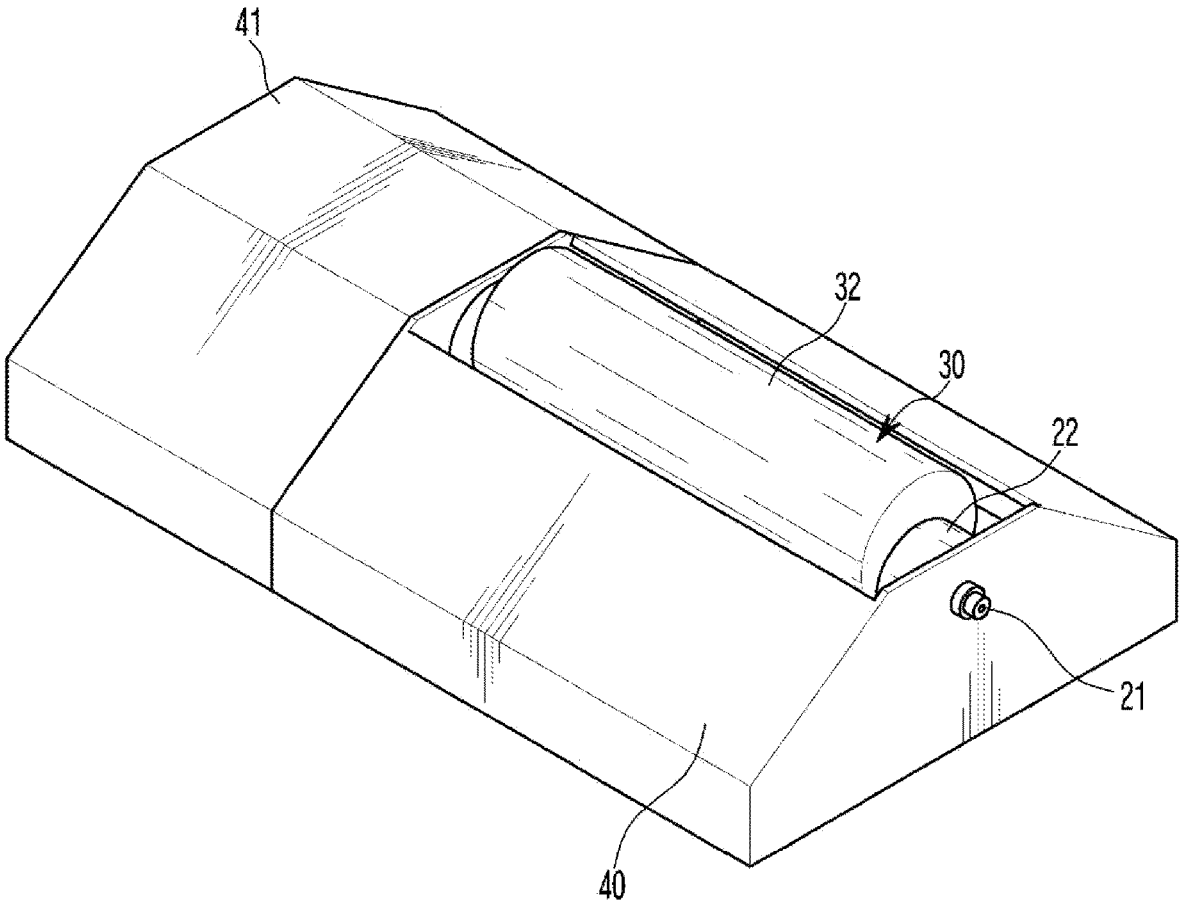
FIG. 1 is a perspective view illustrating a device for strengthening spinal muscles according to a first embodiment of the present invention.
Figure 2:
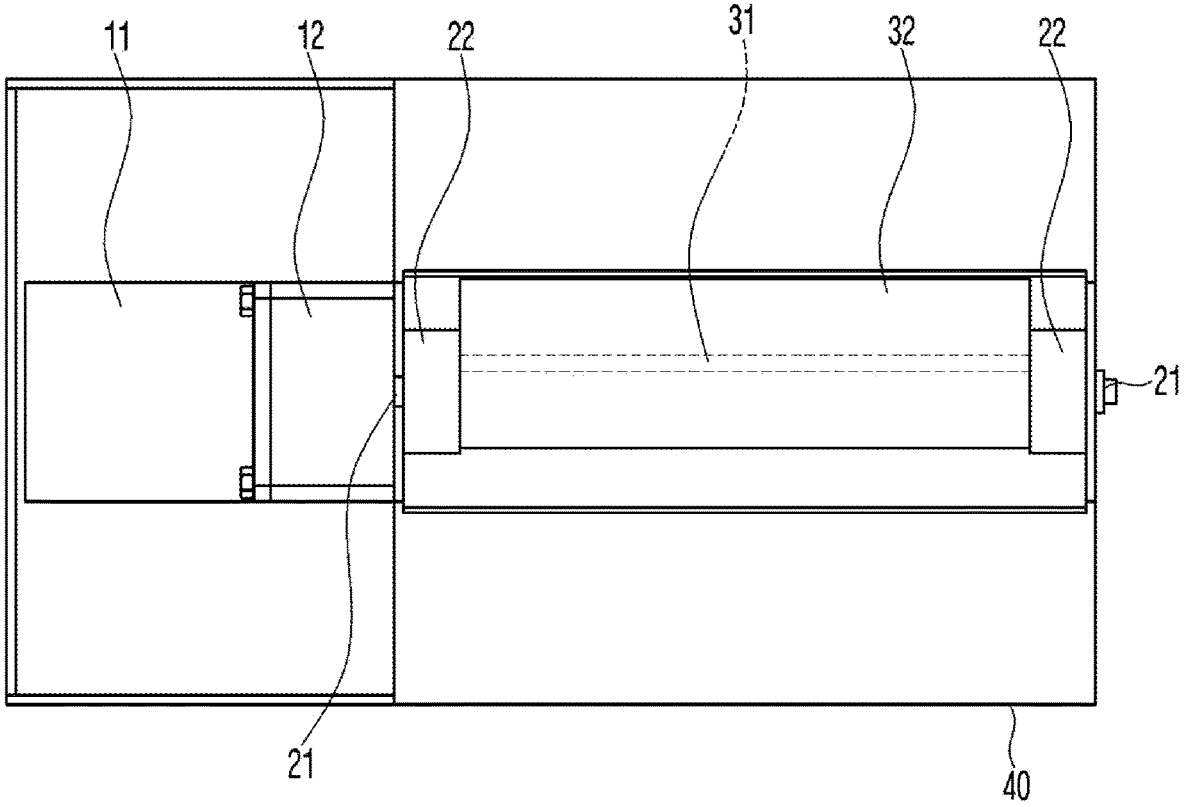
FIG. 2 is a plan view illustrating the device for strengthening spinal muscles according to the first embodiment of the present invention.

Hereinafter, embodiments of a device for strengthening spinal muscles according to the present invention will be described in detail with reference to the accompanying drawings. However, it should be understood that the exemplary embodiments according to the concept of the present invention are not limited to the embodiments which will be described hereinbelow with reference to the accompanying drawings.

FIGS. 1 to 5 illustrate a device for strengthening spinal muscles according to a first embodiment of the present invention, the device including: a driving unit 10 consisting of a motor 11 and a reducer 12; two support portions 20 connected to a shaft 13 of the reducer 12; a press portion 30 eccentrically connected to the support portions 20; and a housing 40 accommodating the driving unit 10, the support portions 20, and the press portion 30.

The motor 11 of the driving unit 10 is connected to the reducer 12. The reducer 12 is connected to a supporter shaft 21 of the support portions 20. A press roller shaft 31 of a press roller 32 is eccentrically connected to each disk 22 of the support portions 20.

The number of press roller 32 according to the first embodiment of the present invention is only one. This is because the contact with the cervical vertebrae is intermittently achieved in the case the number of press rollers 32 is three or more, so that the pressing effect is insufficient. Thus, rotating only one press roller 32 at a slow speed increases the contact time with the cervical vertebrae and maximizes the pressing effect. As a result of several repeated tests by the present inventor, it has been discovered that about 40 rpm of a rotation speed of the reducer is most effective for strengthening the spinal muscles.

The press roller shaft 31 is fixedly coupled to the inside of disks 22 and does not rotate by itself. Alternatively, the press roller shaft 31 may be connected in a manner being rotatable by itself, and a bearing may be provided at a connected portion to reduce frictional force. The press roller 32 is fitted over the press roller shaft 31 so as to be rotatable by itself. A material of the press roller 32 may be rubber, stretchable plastic, or the like.

A force transmitted by the motor 11 through the supporter shaft 21 connected to the reducer 12 causes the disks 22 to rotate, and the press roller shaft 31 connected to the inside of the disks 22 performs the circular motion. When the press roller 32 comes into close contact with the back in accordance with the circular motions of the disks 22 and the press roller shaft 31, the press roller 32 presses the spinal muscles while rotating. As illustrated in FIGS. 1, 2, 3, and 5, the diameter of the press roller 32 is greater than the diameter of the disks 22.

Figure 3A:
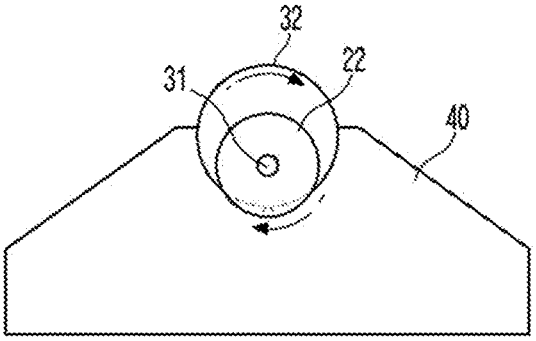
FIGS. 3*a*, 3*b*, 3*c* and 3*d* illustrate views illustrating a state of the device for strengthening spinal muscles according to the first embodiment of the present invention being operated.
Figure 3B:
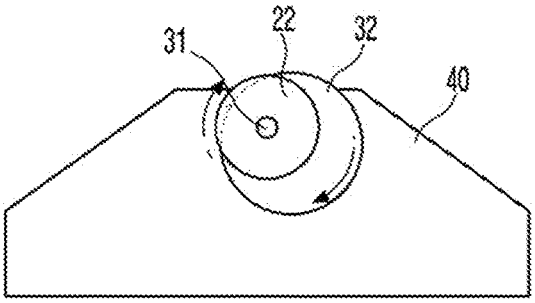
Figure 3C:
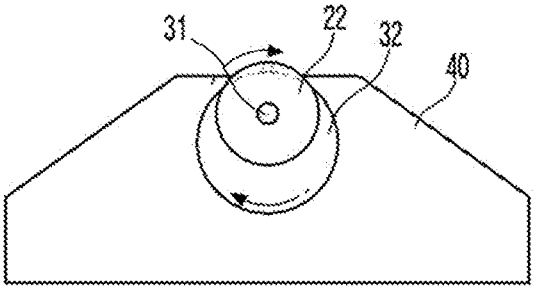
Figure 3D:
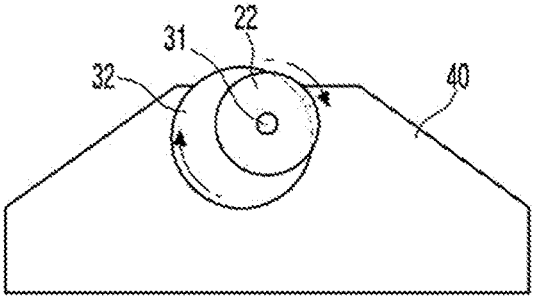
Figure 4:
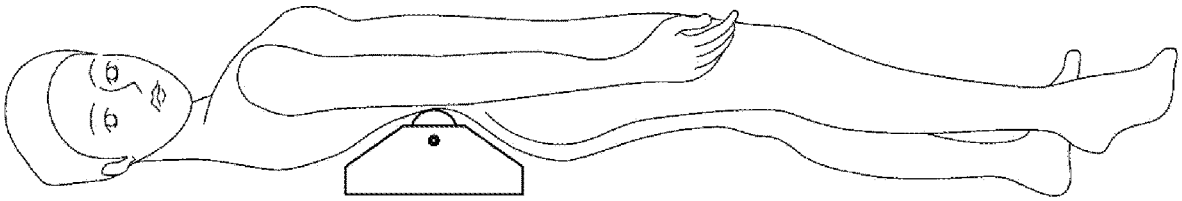
FIG. 4 is a view illustrating a state of the device for strengthening spinal muscles according to the first embodiment of the present invention being used.

FIGS. 3*a*, 3*b*, 3*c* and 3*d* illustrate that an eccentric circular motion of the press roller 32 in order as the disk 22 rotates. FIG. 3*a* illustrates the topmost position of the press roller 32, and FIG. 3*c* illustrates the bottom position of the press roller 32. In FIG. 3*a*, the pressing is performed.

Figure 5:
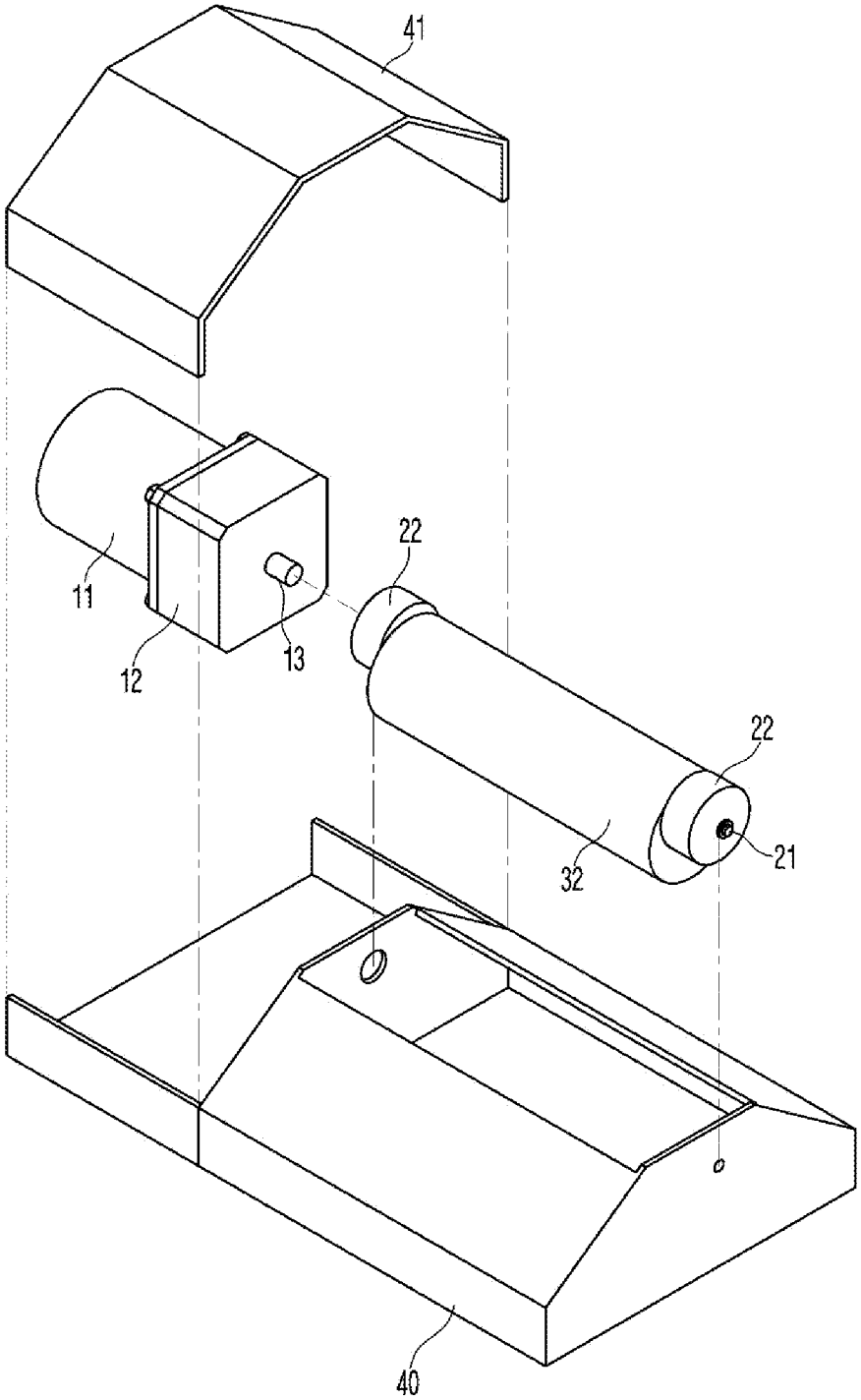
FIG. 5 is an exploded-perspective view illustrating a substantial part of the device for strengthening spinal muscles according to the first embodiment of the present invention.

As illustrated in FIG. 5, the housing is constructed such that a lower surface thereof is flat and a partition wall is provided between the driving unit 10 and adjacent one of the support portions 20. In addition, the housing is constructed such that side walls thereof are trapezoidal and an upper portion thereof is opened such that the press portion 30 protrudes. A hole is formed in the partition wall to allow a shaft of the reducer to pass therethrough, and a hole is formed in a right wall of the side walls to allow the supporter shaft 21 to pass therethrough. In addition, a driving unit cover 41 is provided to cover the driving unit 10.

Figure 6:
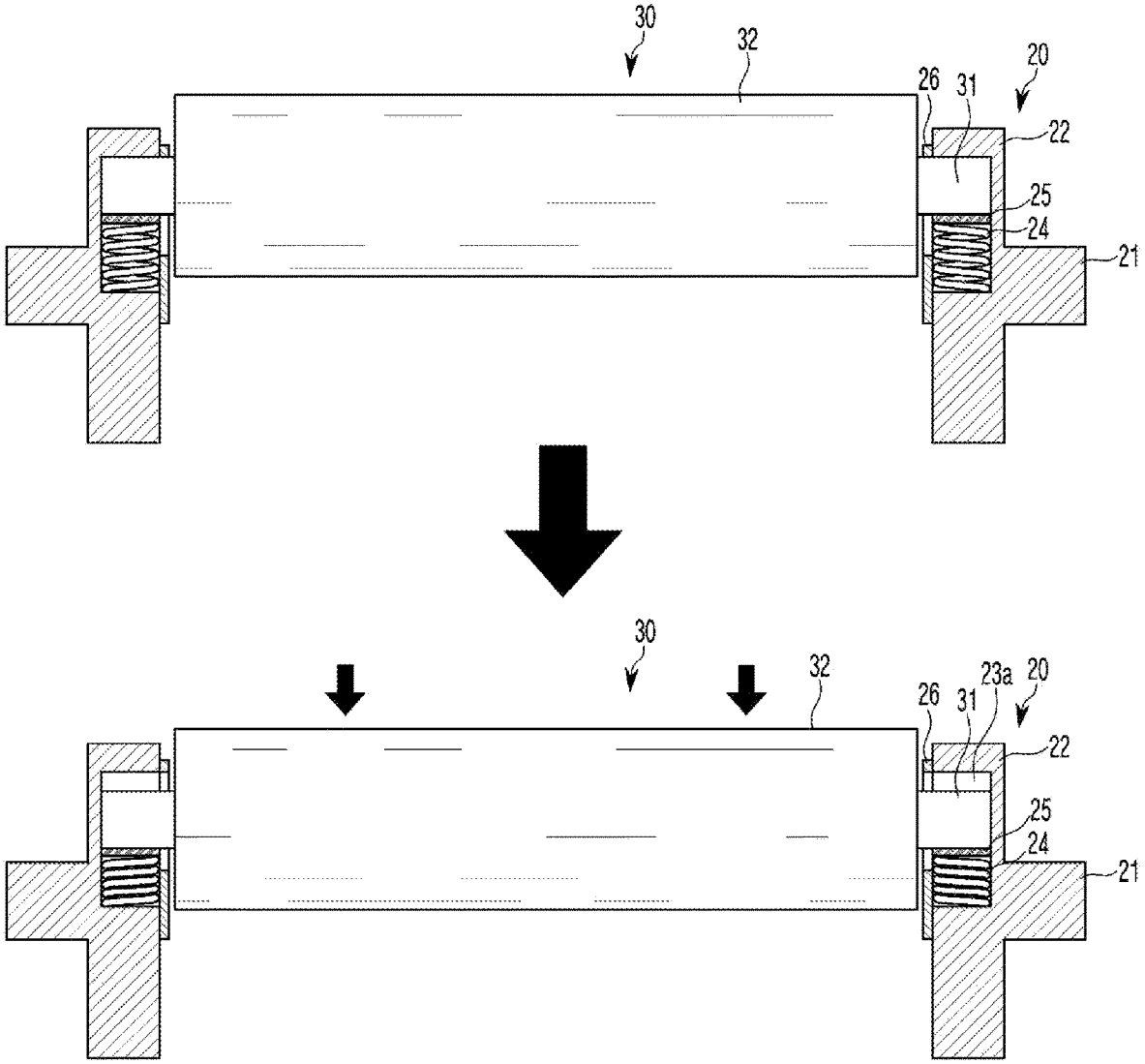
FIG. 6 is a view illustrating a state where support portions and a press portion are combined in a device for strengthening spinal muscles according to a second embodiment of the present invention.
Figure 7:
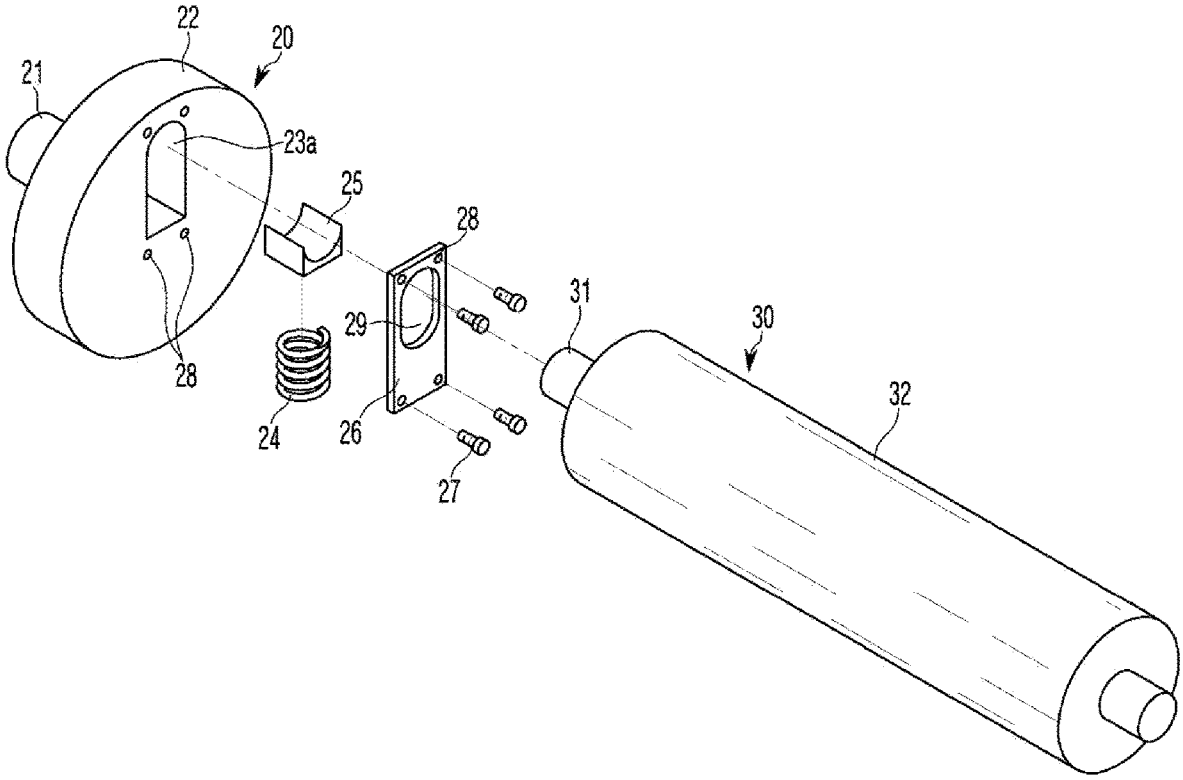
FIG. 7 is an exploded-perspective view illustrating a substantial part of the device for strengthening spinal muscles according to the second embodiment of the present invention.

FIGS. 6 and 7 illustrate a device for strengthening spinal muscles according to a second embodiment of the present invention, wherein springs 24 support the press roller shaft 31 to press the spinal muscles dynamically according to the curves of the spine.

In the device for strengthening spinal muscles according to the second embodiment of the present invention, one of the two support portions 20 is connected to a shaft 13 of the reducer 12 through the supporter shaft 21 provided on an outer side of a corresponding disk 22, and the other support portion 20 is connected to the right wall of the housing 40.

Each of the disks 22 has the supporter shaft 21 on the outer side thereof and has a rectangular recess 23*a* in the inner side by a predetermined depth so as to be positioned in the supporter shaft 21. The recess 23*a* is rectangular in which an upper edge thereof is round and a lower edge thereof is flat. The spring 24 and a supporter 25 are inserted into the recess 23*a* to support the press roller shaft 31. In addition, a cover 26 is provided to cover the recess 23*a*, so that the separation of the spring 24 and the supporter 25 is prevented. Multiple bolt holes 28 are provided around the recess 23*a* to fasten bolts 27. The cover 26 has a rectangular cover opening 29 with rounded upper and lower edges so that the press roller shaft 31 moves up and down dynamically by the movement of the springs 24.

In addition, in order to fasten the cover 26 to the disk 22, multiple bolt holes 28 are provided in the cover 26, corresponding to the number of bolt holes 28 provided in the disk 22.

An upper portion of the supporter 25 is semi-circular to receive the press roller shaft 31 thereon and a lower portion thereof is flat. The spring 24 is positioned under the supporter 25. When the press roller 32 comes into close contact with the back, the press roller 32 moves up and down dynamically according to the curves of the spine, so that a high-intensity force is not applied to a local region.

Figure 8:
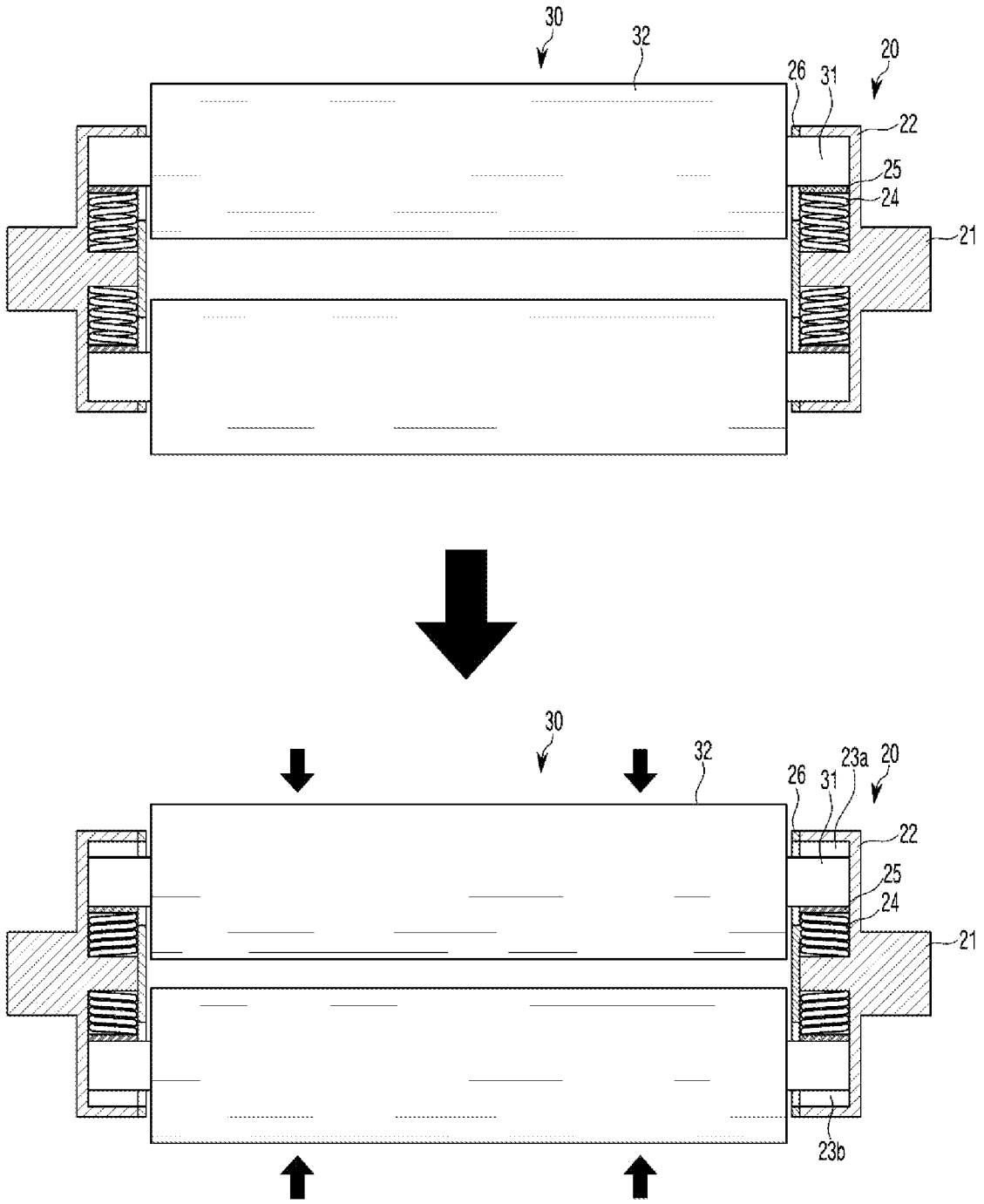
FIG. 8 is an exploded-perspective view illustrating a substantial part of a device for strengthening spinal muscles according to a third embodiment of the present invention.

FIGS. 7 and 8 illustrate that support portions 20 identical to those of the second embodiment are disposed symmetrically about a support plate shaft 21 according to a third embodiment of the present invention. In detail, recesses 23*b* are symmetrically provided on the opposite sides of recesses 23*a*, and the recesses 23*a* accommodate springs 24, supporters 25, covers 26, and a press portion 30.

DESCRIPTION OF THE REFERENCE NUMERALS IN THE DRAWINGS

10: Driving unit
11: Motor 12: Reducer
13: Reducer shaft
20: Support portion
21: Supporter shaft 22: Disk
23*a*, 23*b*: Recess 24: Spring
25: Supporter 26: Cover
27: Bolt 28: Bolt hole
29: Cover opening
30: Press portion
31: Press roller shaft 32: Press roller
40: Housing
41: Driving unit cover

The invention claimed is:

1. A device for strengthening spinal muscles, the device comprising: a driving unit including a motor and a reducer;

two support portions in which one of the support portions is connected to a shaft of the reducer and a remaining one is connected to a side wall of a housing;

a press portion eccentrically connected to a disk of each of the support portions; and the housing accommodating the driving unit, the support portions, and the press portion;

wherein the disk has a supporter shaft on an outer side thereof and has a rectangular recess having a round upper edge and a flat lower edge in an inner side thereof by a predetermined depth, wherein each of the support portions includes:

a spring accommodated in the recess;

a supporter supporting a press roller shaft; and a cover covering the recess to prevent separation of the spring and the supporter and having a rectangular cover opening having rounded upper and lower edges.

2. The device of claim 1, further comprising: an additional spring, an additional supporter, an additional cover, an additional press portion and an additional recess symmetrically disposed to the recess of the disk.

* * * * *